United States Patent [19]

Teplinsky et al.

[11] 4,428,414

[45] Jan. 31, 1984

[54] APPARATUS FOR CLEANING FACED METAL MOULDS OF USED FACING

[76] Inventors: Anatoly D. Teplinsky, ulitsa Generala Petrova, 27, korpus 1, kv. 73; Alexandr F. Jurchenko, ulitsa Paustovskogo, 7, kv. 68; Grigory A. Yarovinsky, Treugolny pereulok, 13, kv. 14, all of Odessa, U.S.S.R.

[21] Appl. No.: 865,220

[22] Filed: Dec. 28, 1977

[51] Int. Cl.[3] ..... B22D 29/00

[52] U.S. Cl. ..... 164/158

[58] Field of Search ..... 164/158; 15/316 R, 405; 141/360, 362

[56] References Cited

U.S. PATENT DOCUMENTS

| | | | |
|---|---|---|---|
| 1,293,604 | 2/1919 | Woolever | 15/316 R |
| 3,186,451 | 6/1965 | Stanley | 141/360 |
| 3,975,109 | 8/1976 | Frazierr | 408/35 |

FOREIGN PATENT DOCUMENTS

| | | | |
|---|---|---|---|
| 325094 | 3/1972 | U.S.S.R. | 164/158 |
| 419315 | 8/1974 | U.S.S.R. | 164/158 |
| 501837 | 4/1976 | U.S.S.R. | 164/158 |
| 509337 | 6/1976 | U.S.S.R. | 164/158 |

*Primary Examiner*—Kuang Y. Lin

[57] ABSTRACT

An apparatus for cleaning faced metal moulds of used facing comprises a frame mounting a barrel rotatable about the horizontal axis thereof. The barrel is formed with openings through which extend bars carrying on their opposite ends traverses with tiltable plates fitted with working tools for chipping off the facing and with nozzles connected to a system for supplying a working agent intended for the removal of used facing. The system for supplying the working agent comprises a fixed valve connected to a working agent source and periodically cooperating, as the traverses carrying the tiltable plates are advanced, with a corresponding receiving branch pipe arranged on the corresponding traverse formed with an interior duct in communication with said branch pipe, directing the working agent toward a header for distributing said working agent among the nozzles. When the barrel rotates, the positions of the traverses are changed, and a second tiltable plate with a set of working tools and nozzles is brought against the metal mould surface to be cleaned.

The apparatus is designed for simultaneous removal of used facing from the surface of two different parts of metal moulds of complicated configuration, inclusive of those with portions protruding above the parting surface.

4 Claims, 6 Drawing Figures

APPARATUS FOR CLEANING FACED METAL MOULDS OF USED FACING

BACKGROUND OF THE INVENTION

1. Field of the Invention

This invention relates to foundry practice, and more particularly to faced metal mould automatic casting lines and is directly concerned with apparatus for cleaning faced metal moulds of used facing.

2. Description of the Prior Art

It is known that faced metal moulds are successfully used for producing quality castings of practically any configuration from various metals, inclusive of cast iron with flaked and spheroidal graphite, carbon and alloyed steel and other metals and alloys, the geometric dimensions ranging from a few dozens of millimeters to one meter and more, and from a few hundred grams to 300 and over kilograms.

It is advantageous to use faced metal moulds for casting of crankshaft for automobile and tractor (inclusive of diesel) engines, camshafts for automobile engines, ribbed frames for electric motors, railway car roller bearing boxes, hydraulic distributor housings with cast conduits, tractor drive sprockets and miscellaneous other items.

An indispensible process operation in faced metal mould casting is the removal, upon demoulding, of used facing from the faced portions of the metal mould. It is necessary to remove both the burnt and partly damaged facing that has come into contact with molten metal and the unburnt facing that has not contacted molten metal.

The quality of cleaning governs that of the fresh facing applied to the faced parts of the metal mould, and thus the quality of castings.

There is known an apparatus for cleaning faced metal mould parts of used facing (see, e.g., R. L. Snezhnoi et al, "Tekhnologicheskiye osnovy i kompleksnaya mekhanizatsiya protsesov polucheniya otlivok iz chernykh splavov v oblitsovannykh kokilyakh"/Process Fundamentals and Complex Mechanization of the Manufacture of Castings from Iron Alloys in Faced Metal Moulds/, "Liteinoye proizvodstvo", 1973, No. 11.

The apparatus referred to above is mounted on a conveying roller table whereon are transferred, working face up, parts of metal moulds to be cleaned of used facing. The apparatus comprises a frame whereupon in pivotally mounted a traverse accommodating a plate provided with a set of working tools for breaking up the facing and with a set of blowing nozzles connected to a system for supplying a working agent such as compressed air intended for removing the burnt and the chipped off facing.

The working tools are formed with sharp-edged rollers carried by spring-loaded oscillating levers. As the parts of the metal mould pass underneath said apparatus, the rollers are forced against the metal mould surface to break up (chip off) the facing in the parting plane.

The apparatus is capable of removing used facing from those parts of metal moulds which have no projections above the parting plane, this greatly restricting the field of application thereof. The apparatus fails to clean those parts of metal moulds having internal cavities whose facing never comes into contact with molten metal, e.g., core seats, etc.

Thus, the use of a single conveyor handling both the top and the bottom metal mould parts, of which at least one has elements protruding above the parting plane, renders such apparatus altogether impractical. The apparatus of this type is also unfit for use where two different kinds of metal moulds are employed in a single production line, which is frequently the case in modern faced metal mould casting lines, with at least one of its parts protruding above the parting plane.

SUMMARY OF THE INVENTION

It is therefore an object of the invention to provide for effective cleaning of faced metal mould parts of any configuration of used facing.

Another object of the invention is to provide an apparatus for cleaning faced metal moulds of used facing ensuring the removal of the used facing off parts of the metal moulds having elements protruding above the parting plane and not contacting molten metal.

These and other objects of the invention are accomplished by the provision of an apparatus for cleaning faced metal moulds of used facing, comprising a frame and a traverse carrying horizontally rotatable plate with working tools for chipping off used facing and nozzles connected to a system for supplying the nozzles with a working agent serving for the removal of the used facing, wherein, according to the invention, there is provided a barrel mounted on a frame for horizontal rotation and formed with orifices through which extend bars each having one end thereof carrying said traversed and plate with the working tools and the nozzles, and the other end carrying additional similar traverse and plate with working tools and nozzles, and wherein the system for supplying the working agent to the nozzles incorporates a valve affixed on the frame, connected to a working agent source and periodically communicating the latter with the nozzles.

The apparatus according to the invention for cleaning faced metal moulds of used facing ensures the removal of used facing from the parts of metal moulds moving along a single conveyor and having various configurations, inclusive of parts protruding above the parting plane or with faced cavities not in contact with molten metal.

In addition, the invention improves the quality of cleaning, and, consequently, that of castings.

The apparatus of the invention expands the process possibilities of faced metal mould automatic casting lines.

It is good practice to fit each traverse with a receiving branch pipe mounted thereon and cooperating with the valve and to make in each traverse a conduit communicating with said branch pipe and directing the working agent toward a header distributing it among the nozzles.

It is advisable to connect at least one traverse to a drive means reciprocating it with respect to the barrel in order to bring the plate carrying the working tools and the nozzles against the metal mould surface to be cleaned.

It is expedient to provide at least one of the traverses with a drive means reciprocating it with respect to the barrel to bring the rotatable plate with the working tools and the nozzles against the metal mould part to be cleaned. It is preferable to gear both plates to a rotation drive means mounted on the barrel and incorporating an output shaft with two ends both ends thereof successively passing through a corresponding traverse, then through a corresponding plate.

This arrangement of the plate rotation drive means substantially simplifies the apparatus design, since both plates are actuated by a single drive means, this making it possible to combine a working stroke of one plate with the idle run of the other and thus to enhance the overall efficiency of the apparatus.

In addition, the location of the drive means inside the barrel simplifies the supply of the working agent thereto.

It is advisable to provide the output shaft ends with cavities communicating both with a conduit inside the traverse and with the header distributing the working agent among the nozzles.

This substantially simplifies the supply of the working agent to the nozzles.

BRIEF DESCRIPTION OF THE DRAWINGS

The invention is further described by way of example in terms of the preferred embodiment with reference to the accompanying drawings, wherein.

DESCRIPTION OF THE PREFERRED EMBODIMENT

Figure 1:
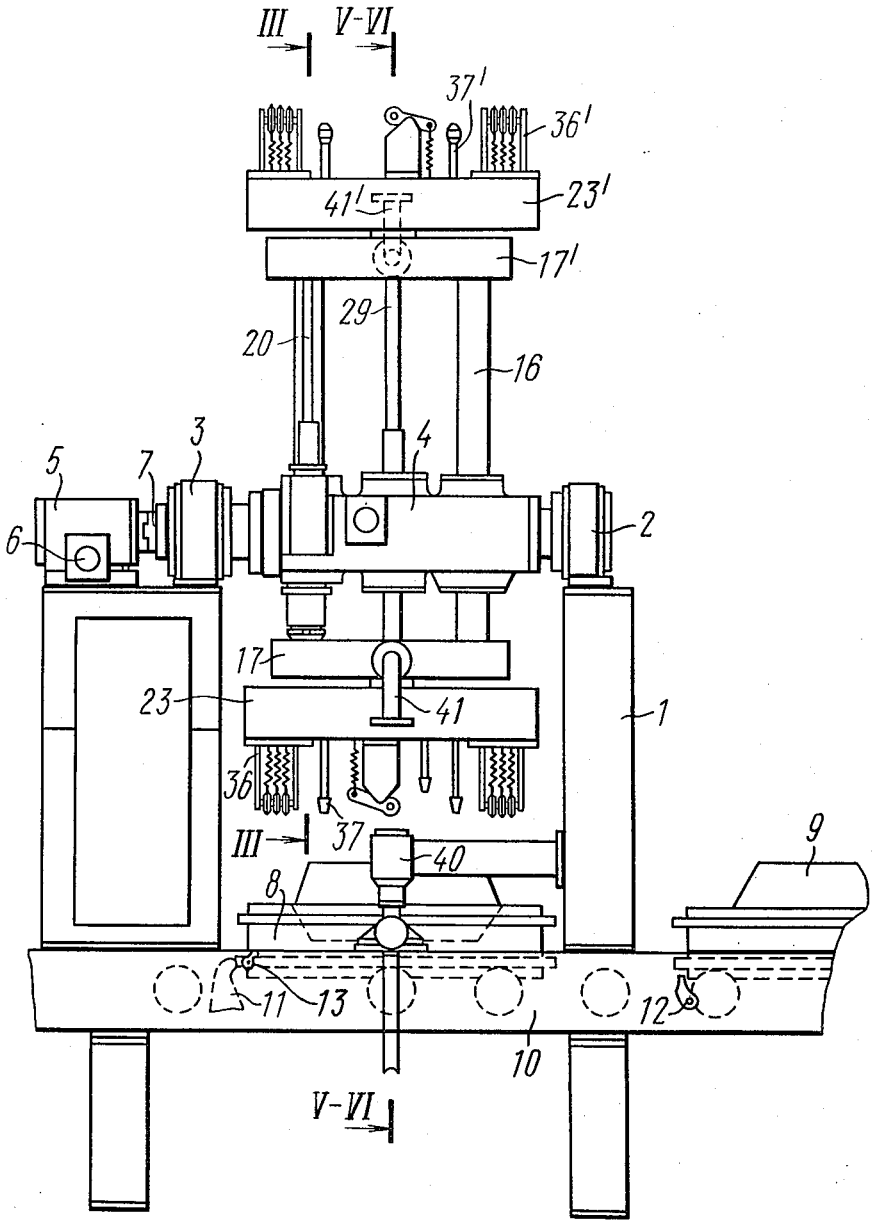
FIG. 1 is a schematic general view of an apparatus for cleaning faced metal moulds of used facing.

The apparatus according to the invention for cleaning faced metal moulds of used facing comprises a frame 1 (FIGS. 1, 2) whereupon are mounted bearings 2 and 3 of a barrel which is rotated horizontally thereabout by means of a drive 5 through a power cylinder 6. The drive means 5 is connected to the barrel 4 through a coupling 7. The metal mould parts 8 and 9 are transferred to the apparatus by a conveyor, e.g., a live roller table 10 provided with a mobile stop, a cut-off 12 and a limit switch 13.

Figure 3:
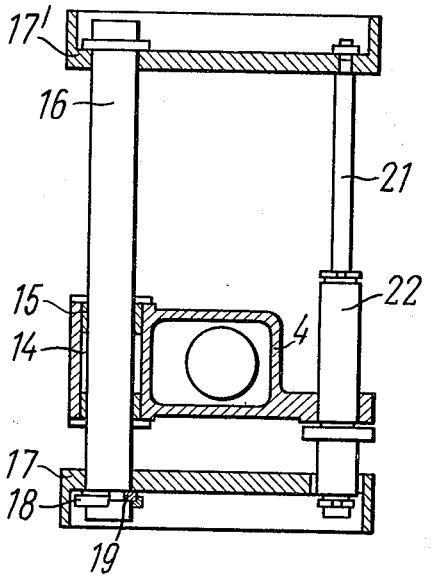
FIG. 3 is a cross section taken on the plane III—III of FIG. 1.

The barrel 4 has through orifices such as shown at 14 in FIG. 3, which receives guide bushes 15 wherein freely mounted are bars 16 on opposite ends thereof being rigidly fixed the traverses 17 and 17'. In the specific embodiment of the invention, the traverses 17 and 17' are secured onto the bars 16 with the aid of flanges 18 and half-rings 19.

The bars 16 with the traverses 17 and 17' are reciprocated with respect to the barrel 4 by a drive means 20 realized in the specific embodiment of the invention as power cylinders rods 21 thereof (FIG. 3) being engaged by the traverse 17 and shells 22 being secured in the barrel 4. The translational motion of the traverses is obtainable with alternative drive means, such as a chain drive means, a rack and gear drive means, the rack being grooved on or fixed to directly the bar 16.

A common drive means for the translational motion of the traverses 17 and 17' makes it possible to substantially simplify the design of the apparatus and to enhance its reliability.

The traverses 17 and 17' carry horizontally rotatable plates 23 and 23' respectively.

The plates 23 and 23' are rotated by a drive means 24 of any convenient design, such as an electric, hydraulic, pneumatic, etc., drive means. The drive means 24 may be placed either inside the barrel 4 or on one of the traverses 17 and 17'.

Figure 4:
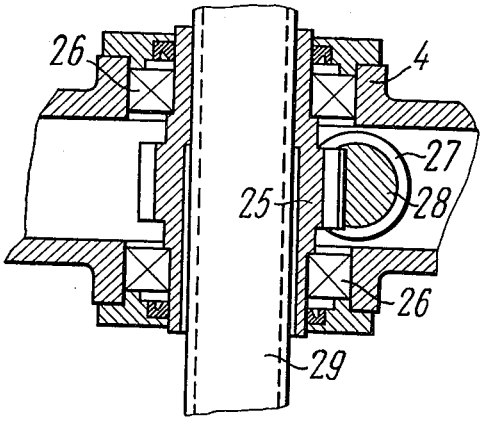
FIG. 4 is a cross section taken on the plane IV—IV of FIG. 2.
Figure 5:
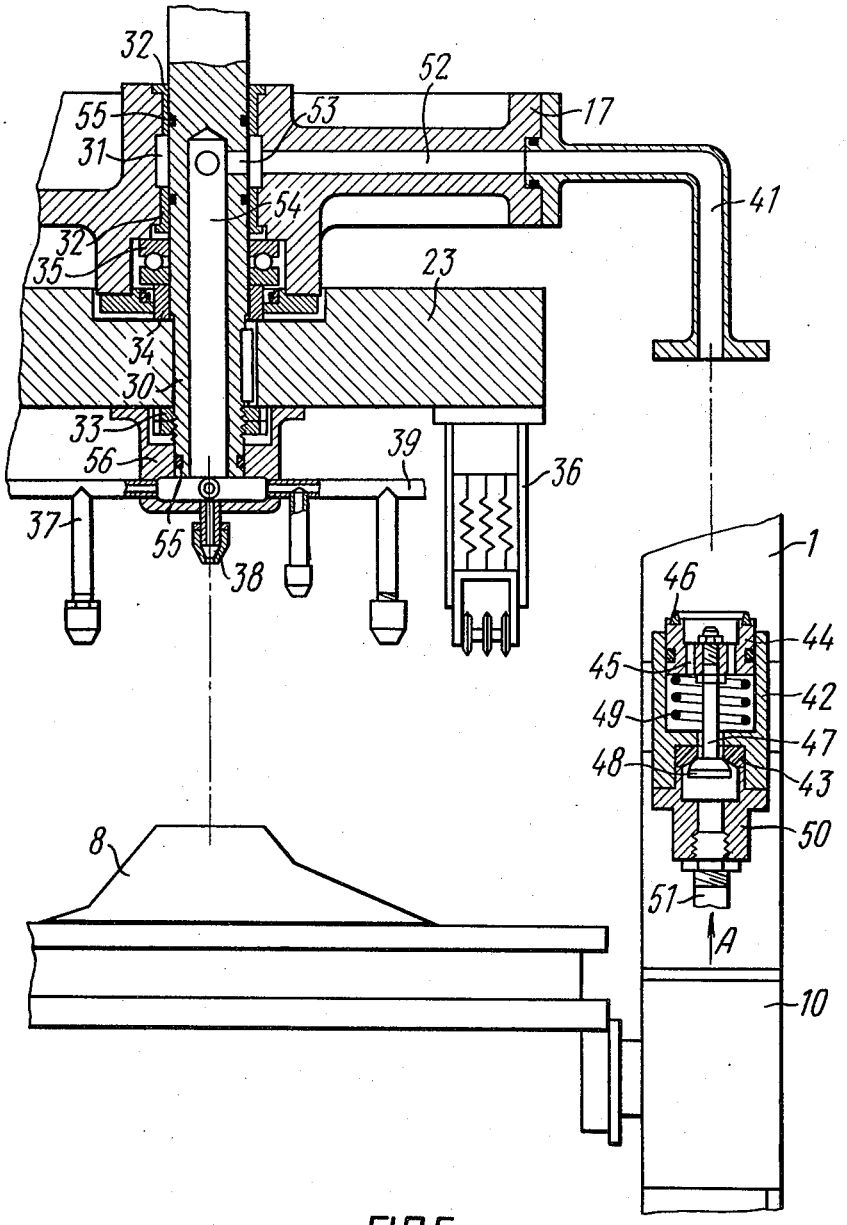
FIG. 5 is a cross section taken on the plane V—V of FIG. 1.
Figure 6:
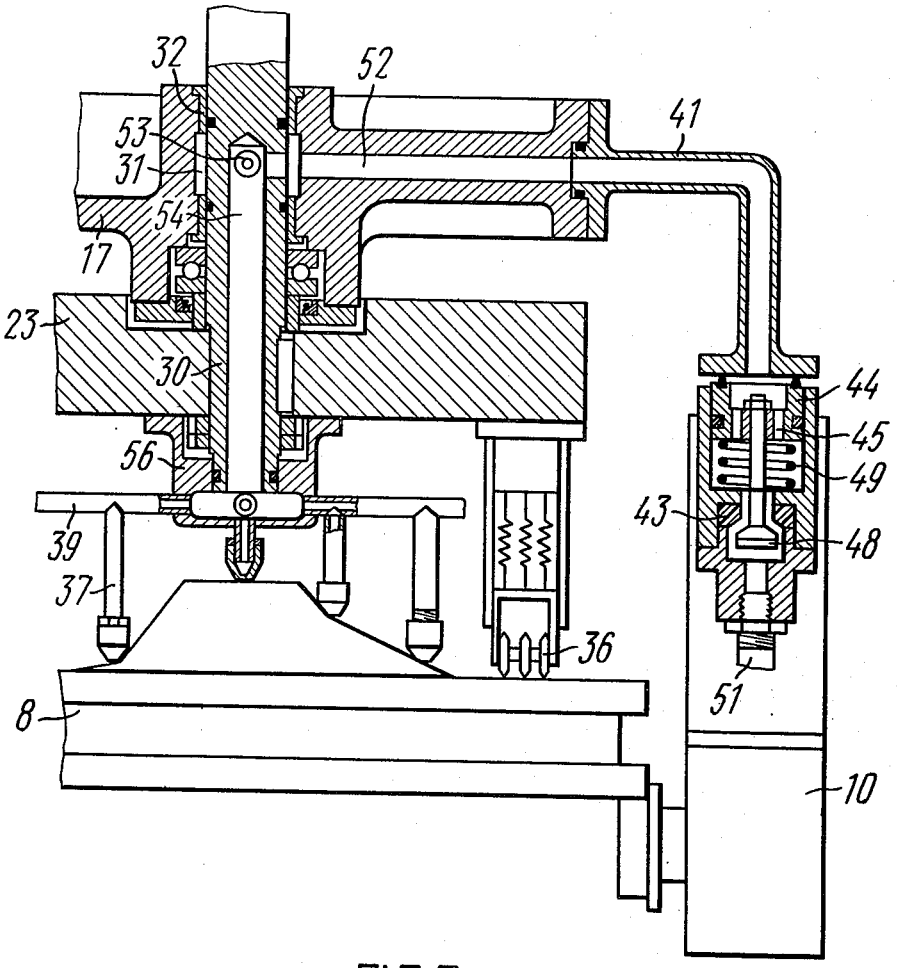
FIG. 6 is a cross section taken on the plane VI—VI of FIG. 1, one of the metal mould parts undergoes cleaning.

In the specific embodiment of the invention, the drive means 24 is placed inside the barrel 4 and includes a gear 25 (FIG. 4) with internal splines rotatable in bearings 26 mounted in the barrel 4. The same barrel 4 accommodates a power cylinder 27 the racked rod 28 thereof cooperating with the gear 25 imparting rotation to output shaft 29 provided with two ends 30 (FIGS. 5 and 6).

In each of the traverses 17 and 17' there is a through orifice 31 which accommodates corresponding bushings 32, each end 30 of the shaft 29 passing successively through the corresponding traverse 17 or 17', the bushings 32 serving as additional supports for the shaft 29 which then receives in a rigid engagement the plate 23 or 23' attached to the ends 30 of the shaft 29 by means of nuts 33 which tighten the plates 23 and 23' against the traverses 17 and 17' respectively through the mediacy of a distance bushing 34 and an axial bearing 35.

The provision of the bearings 35 ensures a ready rotation of the shaft 29 when taking up the axial forces from the plates 23 and 23' due to the resistance the facing offers to chipping.

The shaft 29 is also provided with splines which make possible its translational motion together with the traverses 17 and 17' in the gear 25.

The provision of a common drive means for rotating the plates 23 and 23' substantially simplifies the overall design of the apparatus.

The plates 23 and 23' carry the working tools 36 and 36' respectively for chipping off the facing and the nozzles 37 and 37' connected to a system for supplying the working agent whose function is to remove the burnt facing after it has been chipped off. The nozzles 37 or 37' are fitted with adjustable tips 38 and united by a common header 39 distributing the working agent among said nozzles.

The working tools 36 and 36' are intended to chip off the facing out of contact with molten metal. They may be variously designed but in the specific embodiment of the invention they are formed with a plurality of sharp-edged rollers mounted on spring-loaded oscillatable levers (see "Liteinoye proizvodstvo", 1973, No. 11).

The working tools 36 and 36' for chipping off used facing are placed on plates 23 and 23' in several rows to suit the configuration of the surface to be cleaned, this minimizing the angle of rotation of the plates 23 and 23'.

The arrangement of the nozzles 37 and 37' is also governed by the configuration of the part of the metal mould to be cleaned.

The working agent is supplied to the header 39 via a valve 40 arranged on the frame 1 and connected to a working agent source (not shown on the drawing), e.g., to a compressed air mains, said valve periodically cooperating alternately with hollow receiving branch pipes 41 and 41' provided respectively on each of the traverses 17 and 17'.

The valve 40 (FIG. 5) comprises a housing 42 rigidly secured to the frame 1. The housing 42 accommodates an elastic seat 43 and a mobile sleeve 44 with through orifices 45 at the end. The sleeve 44 is provided at its end with a seal 46 and engaged by rod 47 of valve 48 coacting with the seat 43. A valve 48 is forced permanently against the seat 43 by the action of a spring 49 and the working agent. The working agent is supplied along the arrow "A" to the valve 40 via a receiving flange 50 through a pipe 51 connected to a working agent source.

The traverses 17 and 17' are provided with conduits 52 communicating with the branch pipes 41 and 41' respectively, and through orifices 53 and cavities 54 made in the ends 30 of the shaft 29, with the header 39 the ends 30 of the shaft 29 are sealed with the aid of elastic rings 55 and caps 56.

The above system for supplying the working agent to the nozzles eliminates hoses, rotatable distributing headers and other arrangements and thus substantially simplifies the working agent supply system. This also ensures a high reliability of operation of the apparatus, since the working agent is supplied to the nozzles when the apparatus is in the working position only.

To provide normal sanitary and hygienic conditions, the apparatus is enclosed in a dust- and sound-proof casing connected to a ventilation system (not shown on the Fig.).

The proposed apparatus for cleaning faced metal mould of used facing operates as follows.

The part 8 of a metal mould conveyed by a live roller table 10 (FIGS. 1, 2) is locked in the cleaning position by a controllable mobile stop 11. Once the part 8 of the metal mould comes against the stop 11 and the limit switch 13, the cut-off 12 is closed so that no other part 9 of the metal mould can be moved into the working position.

The traverse 17 is lowered by the power cylinders 10 on the bars 16 until the working tools 36 abut against the parting plane surface of the metal mould part 8, and the apparatus comes to position shown in FIG. 6. As the transitional motion of the traverse 17 is completed, the branch pipe presses against the end of the sleeve 44 of the valve 40 to force the valve 48 away from the seat 43 thus opening the flow of the working agent from the pipe 51 into the branch pipe 41, then via the conduit 52 of the orifice 53 and the cavity 54 at the end 30 of the shaft 29 into the cap 56, and therefrom into the header 39 and the nozzle 37.

The power cylinder 27 (FIG. 4) of the drive means 24 is energized simultaneously with the flow of the working agent to turn horizontally through a specified angle the gear 25 and therewith the shaft 29 and the plates 23, 23' with the working tools 36, 36', the header 39 and the nozzles 37, 37'.

During said rotation, the ends 30 of the shaft 29 rotate in the bushing 32 arranged in the through orifices 31 of the traverses 17 and 17'.

As the plate 23 (FIGS. 5, 6) rotates, the working tools 36 break up the facing. Similarly, the working agent is blown through the nozzles 37 upon the working and the parting plane surfaces of the part 8 of the metal mould to remove the burnt facing that has been chipped off. The working tools 36 and the nozzles 37 are arranged in a plurality of rows that follow the configuration of the metal mould and thus clean all of its surface.

Once the cleaning is completed, the traverse 17 (FIGS. 1, 2, 5, 6) with the plate 23 rises back to original position, the branch pipe also rising in the process and the sleeve 44 of the valve 40 following it under the action of the spring 49.

Thus the moment the branch pipe 41 is forced away from the sleeve 44, the valve 48 is pushed against the seat 43, and the flow of the working agent in the branch pipe 41, and, in consequence, towards the nozzle 37 ceases.

Once the traverse 17 with the plate 23 is in the top position, the part 8 of the metal mould, even if it incorporates protruding elements, has enough clearance to pass underneath the working tools 36 and the nozzles 37.

After the traverse 17 and with it the traverse 17' rise, the stop 11 and the cut-off 12 are opened, the part 8 of the metal mould moves out of the apparatus and its place in the cleaning position (on the stop 11) is taken by the part 9 of the metal mould, the cut-off 12 then closing to prevent other parts of the metal mould to enter the cleaning position.

At the same time, the barrel 4 is rotated in the bearings 2 and 3 through 180° with the aid of the drive means 5, and the traverse 17' with the plate 23', the working tools 36' and the nozzles 37' move into the working position to clean the metal mould part 9.

As the plates 23 and 23' turn in different directions, there is no idle run of the cylinder 27 and no idle rotation of the plates 23 and 23'. The plates come to original position as the opposite plate effects its rotation to working position.

To reduce the stroke of the cylinder 20 controlling the translational motion of the traverses 17 and 17' and thus minimize the overall dimensions of the apparatus, the traverses 17 and 17' with the plates 23 and 23' may be moved into and out of the working position by means of a step-by-step rotation of the barrel 4. The latter, after the traverse 17 and the plate 23 have been lifted, is first turned through 90° to come to a position shown in FIG. 2 in broken lines (bars 16 being horizontal).

Figure 2:
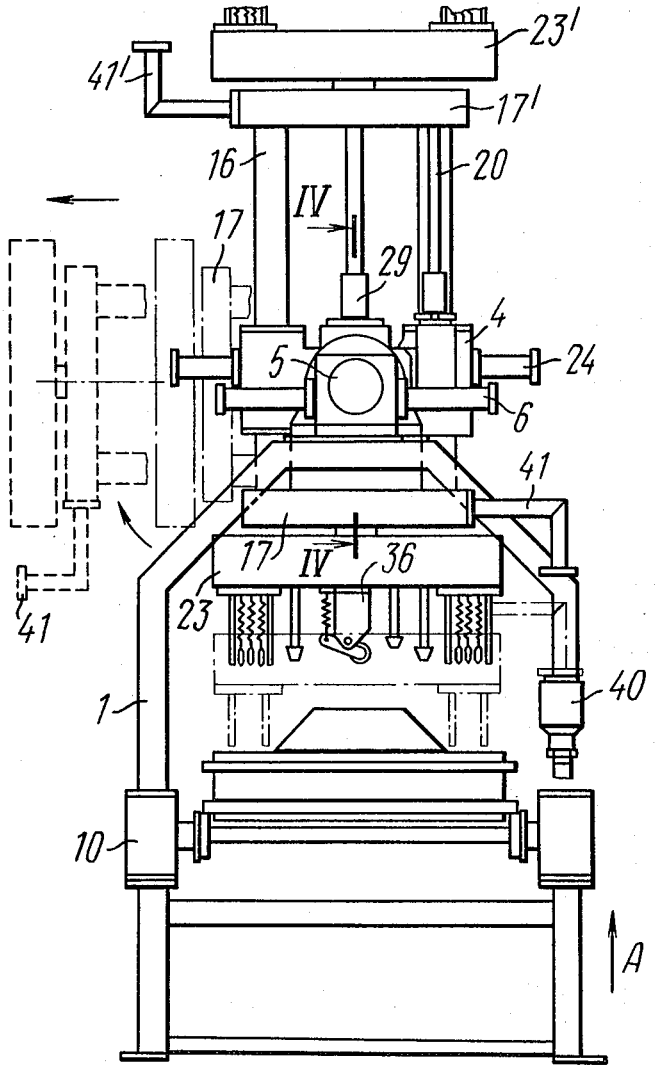
FIG. 2 is a side elevation of same.

With the barrel 4 is said position, the traverses 17 and 17' move to the left to a position illustrated on FIG. 2 by broken lines, the barrel 4 then being rotated through the remaining 90°, and the apparatus comes to a position shown on FIGS. 1 and 2, the only difference being that the traverse 17 is at the top, and the traverse 17' at the bottom (when in the working position), and the apparatus is ready for cleaning the metal mould part 9.

Thus the proposed apparatus for cleaning faced metal moulds of the used facing makes it possible to efficiently clean two different parts of metal moulds of complicated configurations, inclusive of ones having elements protruding above the parting plane.

The proposed apparatus expands the process possibilities of faced metal mould casting units, enhances their versatility and efficiency and improves the facing of metal moulds and, in consequence, the quality of castings.

What is claimed is:

1. An apparatus for cleaning faced metal moulds of used facing comprising:

a frame;

stationary bearings mounted in said frame;

a barrel journalled in said bearings for rotation about a horizontal axis;

first drive means for imparting said barrel rotation about a horizontal axis, mounted on said frame and geared to said barrel;

through orifices in said barrel;

bars passing freely through said orifices in said barrel and provided with two ends;

traverses rigidly fixed on each end of said bars;

second drive means reciprocating said bars together with said traverses with respect to said barrel;

rotatable plates mounted on said traverses and alternately coacting with separate parts of metal mould being cleaned;

third drive means geared to said rotatable plates rotating them horizontally;

working tools for chipping off used facing arranged on said rotatable plates;

a system for supplying a working agent for removing used facing having:

a valve source accommodated on said frame and connected to a working agent source;

receiving branch pipes mounted one each on each of said traverses and cooperating alternately with said valve during the reciprocation of said traverses;

conduits realized one each in each of said traverses and communicating with said receiving branch pipes;

headers mounted on said rotatable plates communicating with said conduits; and nozzles mounted on and in communication with said headers whereby said headers supply and distribute working agent to said nozzles.

2. An apparatus as claimed in claim 1, wherein at least one of said traverses is connected to said second drive means to bring said rotatable plate with said working tools and nozzles against the surface of metal mould to be cleaned.

3. An apparatus as claimed in claim 1, wherein said third drive means is mounted in said barrel and provided with an output shaft with two ends of which each passes successively first through a corresponding said traverse, then receives a corresponding said rotatable plate.

4. An apparatus as claimed in claim 3, wherein each said end of said output shaft of said third drive means has a cavity communicating with both said conduit in said traverse and said header distributing said working agent among said nozzles.

* * * * *